United States Patent [19]

Schreckenberg

[11] Patent Number: 4,667,564

[45] Date of Patent: May 26, 1987

[54] APPARATUS FOR CLEARING LIGHT LAND MINES

[75] Inventor: Klaus Schreckenberg, Vellmar, Fed. Rep. of Germany

[73] Assignee: Thyssen Industrie Aktiengesellschaft, Essen, Fed. Rep. of Germany

[21] Appl. No.: 713,772

[22] Filed: Mar. 19, 1985

[30] Foreign Application Priority Data

Mar. 21, 1984 [DE] Fed. Rep. of Germany ..... 3410332

[51] Int. Cl.[4] ..... F41H 11/16

[52] U.S. Cl. ..... 89/1.13; 89/36.08; 102/402

[58] Field of Search ..... 89/1.13, 36.08; 102/402

[56] References Cited

U.S. PATENT DOCUMENTS 2,455,636 12/1948 Woolson ..... 89/1.13
2,486,372 10/1949 Rockwell ..... 89/1.13
4,593,766 6/1986 Gossard ..... 89/1.13

FOREIGN PATENT DOCUMENTS 2318055 10/1974 Fed. Rep. of Germany ..... 89/1.13
3127856 2/1983 Fed. Rep. of Germany ..... 89/1.13
2149357 6/1985 United Kingdom ..... 89/1.13

*Primary Examiner*—Frederick R. Schmidt
*Assistant Examiner*—Robert A. Rose
*Attorney, Agent, or Firm*—Becker & Becker, Inc.

[57] ABSTRACT

An apparatus for clearing land mines. The apparatus is provided with clearing elements which can freely move up and down independently of one another, and which are disposed in a movable carrier which is embodied as an attachment for a tracked or wheeled vehicle. Each clearing element is a small, rigid clearing plate having a supporting arm, which is suspended on a support associated with the movable frame, and is movable about a horizontal pivot axis which extends transverse to the direction of travel. The supporting arms of all of the clearing plates are the same length. All of the clearing plates, without contacting one another and at a slight distance from one another, are disposed in a compound arrangement which is parallel to the support and is arranged behind the latter in the direction of travel. The compound arrangement is either V-shaped, having its point facing in the direction of travel, or extends continuously at an angle to the direction of travel.

6 Claims, 5 Drawing Figures

APPARATUS FOR CLEARING LIGHT LAND MINES

BACKGROUND OF THE INVENTION

The present invention relates to an apparatus for clearing or removing light land mines; the apparatus has clearing elements which can freely move up and down independent of one another, and which are disposed in a movable carrier which is embodied as an attachment for a tracked or wheeled vehicle.

DESCRIPTION OF THE PRIOR ART

Light land mines are, for example, dropped from aircraft and, in contrast to conventional buried mines, are exposed or are more or less covered in the ground by a thin layer of earth.

German Offenlegungsschrift No. 20 48 921 discloses a so-called mine-clearing apparatus, according to which a plurality of heavy drums or rollers are located in a movable frame which is pushed by a vehicle. The rollers are in the form of spatially free elements which are movable independently of one another; transverse to the direction of travel, these elements are disposed behind and next to one another, as well as offset relative to one another. As the rollers roll over the mines, the weight of the rollers detonates the mines. This type of mine clearing does have the advantage that due to the spatially freely movable suspension of each roller, the latter can essentially conform to even rolling and uneven terrain. However, a drawback is that, depending upon the terrain, for example when traveling over a small elevation or over ruts, at least one of the rollers does not make constant contact with the ground over its entire width, so that this heretofore known mine-clearing apparatus is unsatisfactory in use. Furthermore, in order to provide the necessary detonation pressure, this apparatus must be heavy and stable, which detracts from its maneuverability.

German Offenlegungsschrift No. 31 27 856 discloses a land mine clearing apparatus which is pushed by a vehicle, and which is provided with rotating clearing elements disposed at an angle to the direction of travel; with these elements, a layer of earth containing a mine is picked up while expending considerable energy, and is thrown to the side. The traveling speed of such an apparatus is greatly reduced as a result of the layer of earth which is moved with the mines, and thus adversely affects the mobility of the pushing vehicle. However, in combat, such a delay is undesirable.

An object of the present invention is to provide an apparatus for clearing light land mines, which apparatus, in any terrain through which there is no path, even in very rugged terrain, remove only the mines from the clearing region. Furthermore, the apparatus should be capable of being rapidly connected to any type of armored vehicle, even one brought along by small troop units.

BRIEF DESCRIPTION OF THE DRAWINGS

These objects, and other objects and advantages of the present invention, will appear more clearly from the following specification in conjunction with the accompanying schematic drawings, in which.

SUMMARY OF THE INVENTION

The mine-clearing apparatus of the present invention is characterized primarily in that each clearing element is a small, rigid clearing plate having a supporting arm which is suspended on a support associated with the movable carrier, and which is pivotable about a horizontal pivot axis which extends transverse to the direction of travel, with the supporting arms of all of the clearing plates being the same length; and in that all of the clearing plates, without contacting one another and at a slight distance next to one another, are disposed in a compound arrangement which is parallel to the support and is arranged behind it when viewed in the direction of travel; the compound arrangement is either V-shaped, with its point facing in the direction of travel, or extends continuously at an angle to the direction of travel.

Pursuant to advantageous specific features of the present invention, the supporting arm of a given clearing plate may be disposed between two bearing brackets mounted on the support, and may be connected with these brackets by a bearing pin. The supporting arm of a given clearing plate may be made in one piece and curved. Alternatively, the supporting arm may comprise two linear sections which are interconnected via a joint having a safety element, such as a shearing pin.

DESCRIPTION OF PREFERRED EMBODIMENTS

Figure 1:
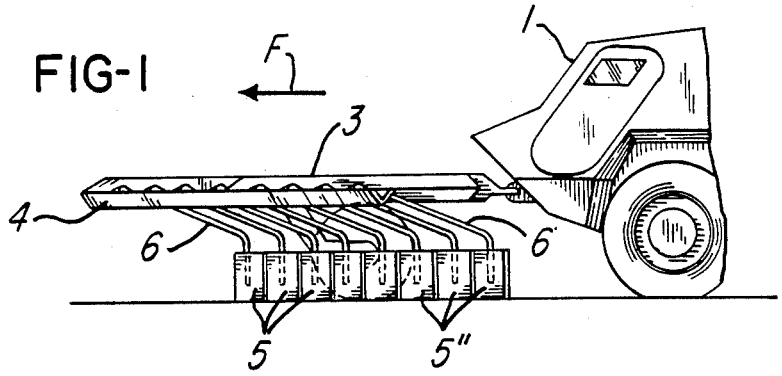
FIG. 1 is a side view of a partially illustrated armored wheeled vehicle, with one embodiment of the inventive apparatus being connected to the front of the vehicle.

Referring now to the drawings in detail, the apparatus for removing or clearing light land mines by pushing them aside can be connected to a pushing vehicle 1, and includes a movable frame or carrier 3 which is equipped with at least one wheel 2. Attached to the front end of the carrier 3, when viewed in the direction of travel as indicated by the arrow F, is a support 4 for receiving clearing elements which can move up and down. The support 4, which, for example, comprises an angle section, is wedge-shaped in the direction of travel in the embodiment illustrated in FIGS. 1 and 2. Each of the clearing elements comprises a small, rigid clearing plate 5 which has a supporting arm 6. Via a bearing pin 7 at its free end, each supporting arm 6 is suspended in two parallel bearing brackets 8 and 9, which extend in the direction of travel, and are fixedly mounted on the support 4. Each supporting arm 6 is movable about a pivot axis 10 which extends transverse to the direction of travel. The small clearing plates 5 are disposed next to one another and parallel to the support 4 in such a way that on the one hand they form a closed row, and on the other hand they can move freely about their pivot axis 10 independently of one another. The movement of each clearing plate 5 about its pivot axis 10 is coordinated in such a way that lines or other loose obstacles up to a weight of about 12 kg can be pushed aside by the clearing plates.

Figure 5:
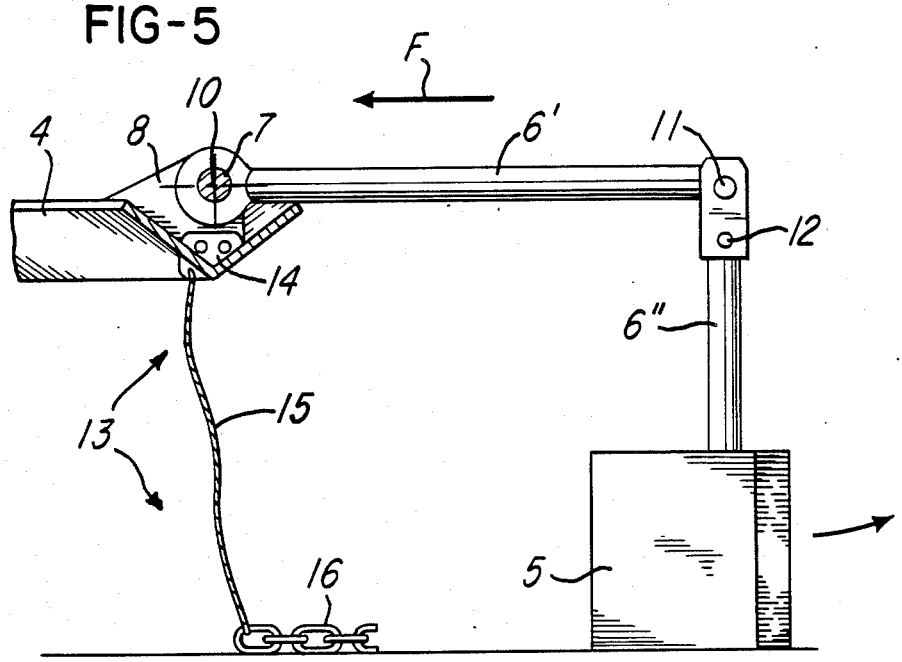
FIG. 5 is a enlarged side view of a further inventive embodiment of a clearing plate and its support means; to facilitate illustration, only one bearing bracket for the clearing plate is shown.

If with these measures loose earth is possibly also moved along, this, due to the fact that the clearing plates lie over the surface of the earth, is unintentional and has no influence on the actual clearing process. Only when an overweight obstacle, such as a large rock or boulder, is encountered, does the front longitudinal edge, when viewed in the direction of travel, of at least one of the clearing plates glide over the obstacle, either by raising or by swinging out (FIG. 5). For this purpose, when the supporting arm comprises two sections 6' and 6'' which are interconnected by means of a joint 11, a shearing pin 12 is provided. When a rut is encountered, the clearing plates 5 located thereabove are, in conformity with the width of the rut, moved upwardly about their pivot axes, so that all of the clearing plates have uninterrupted contact with the ground.

Figure 2:
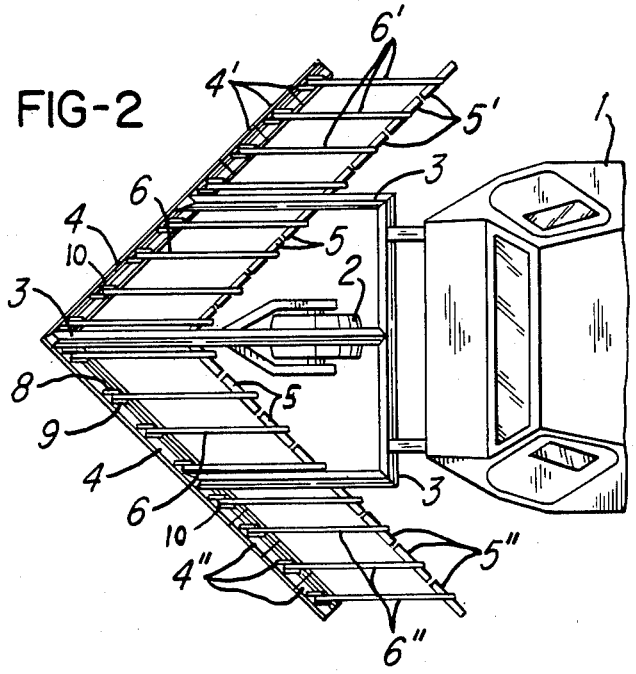
FIG. 2 is a plan view of the arrangement of FIG. 1, with the inventive apparatus being extended beyond both sides of the width of the pushing vehicle.
Figure 3:
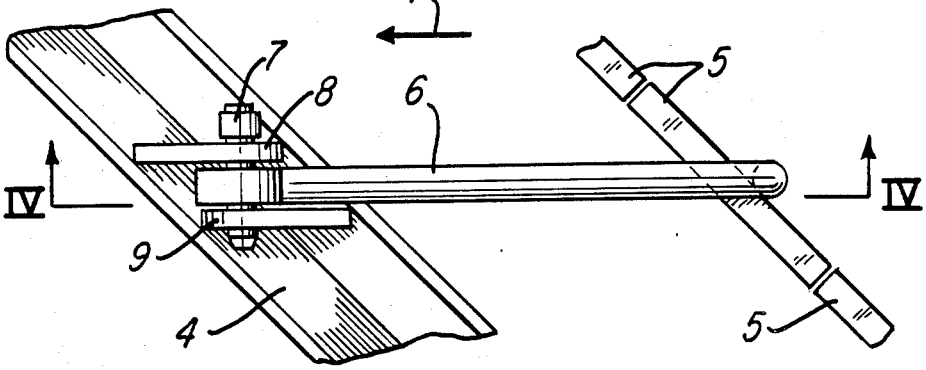
FIG. 3 is an enlarged plan view of a portion of a clearing plate arrangement with the support means therefor.
Figure 4:
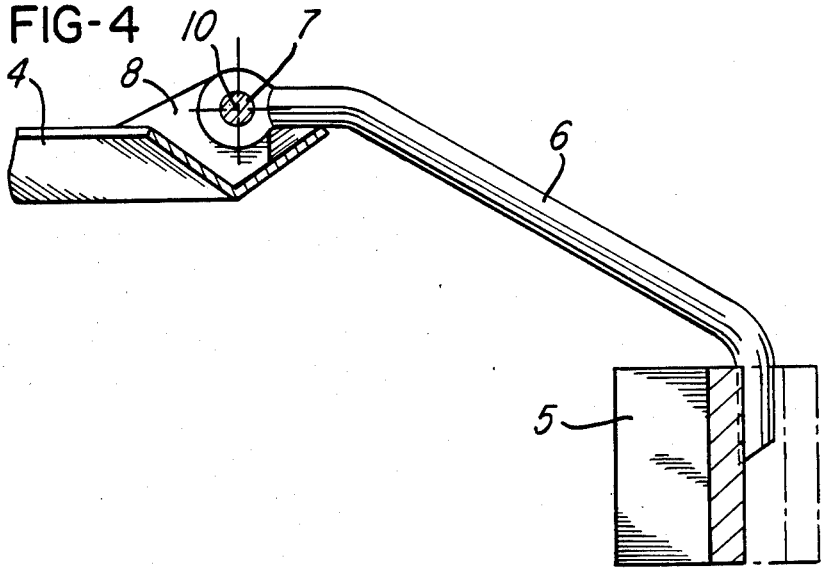
FIG. 4 is a section taken along the line IV—IV in FIG. 3.

In the event a band of mines on the ground is to be cleared which exceeds the width of the pushing vehicle, the support 4 can, as illustrated in FIG. 2, be expanded by one or more support sections 4' or 4'', each of which is provided with one or more clearing plates 5' or 5''.

Since land mines are equipped with various ignition devices, which respond, for example, to vibrations or magnetic field changes, and can be prematurely triggered by the clearing apparatus prior to being pushed aside, there can be mounted on the support 4, which supports the plurality of clearing plates 5, not only a device 13 for mechanical ignition, but also a device 14 for magnetic ignition. The device 13 for mechanical ignition can, for example, comprise a cable 15 and, connected thereto, an element 16, such as a chain or the like, which is to be dragged over the ground which is to be cleared.

During premature detonation of mines, the individual clearing plates can swing outwardly, as they do when they pass heavy obstacles, and in so doing are extensively protected. Furthermore, the clearing plates diminish the effect of the detonation on the pushing vehicle.

Nonetheless, should clearing plates 5 be damaged, and hence made unuseable, due to a detonation in the vicinity of the clearing apparatus, these clearing plates can be quickly, easily, and without difficulty replaced by new clearing plates.

The present invention is, of course, in no way restricted to the specific disclosure of the specification and drawings, but also encompasses any modifications within the scope of the appended claims.

What I claim is:

1. An apparatus for clearing land mines; said apparatus being provided with clearing elements which can freely move up and down independently of one another, and which are disposed in a movable carrier which is embodied as an attachment for a vehicle; the improvement comprising:

a support attached to said carrier; and clearing elements, each of which comprises a small, rigid, clearing plate, and a supporting arm having two ends, one of which is connected to said clearing plate, and the other of which is mounted on said support in such a way as to be pivotable about a substantially horizontal pivot axis which extends transverse to the direction of travel of said vehicle; the supporting arms of all of said clearing plates have the same length; all of said clearing plates, without contacting one another, and at a slight distance from one another, are disposed in a compound arrangement which is parallel to said support and is disposed behind the latter when viewed in the direction of travel of said vehicle; and which includes, for each of said supporting arms of said clearing plates, two bearing brackets mounted on said support; said supporting arm is disposed between said bearing brackets, and is connected to the latter by means of a bearing pin.

2. A mine-clearing apparatus according to claim 1, in which said compound arrangement of said clearing plates is V-shaped, with its point facing in the direction of travel of said vehicle.

3. A mine-clearing apparatus according to claim 1, in which said compound arrangement of said clearing plates extends continuously at an angle to the direction of travel of said vehicle.

4. A mine-clearing apparatus according to claim 1, in which each of said supporting arms is curved and in one piece.

5. A mine-clearing apparatus according to claim 1, in which each of said supporting arms comprises two linear sections, which are interconnected by means of a joint having a safety element.

6. A mine-clearing apparatus according to claim 5, in which said safety element is in the form of a shearing pin.

* * * * *